US007845982B1

(12) United States Patent
Wang

(10) Patent No.: US 7,845,982 B1
(45) Date of Patent: Dec. 7, 2010

(54) DISPLAY PORT SOCKET

(75) Inventor: Jung-Jui Wang, Taipei (TW)

(73) Assignee: Compupack Technology Co., Ltd., Taipei (TW)

( * ) Notice: Subject to any disclaimer, the term of this patent is extended or adjusted under 35 U.S.C. 154(b) by 0 days.

(21) Appl. No.: 12/499,245

(22) Filed: Jul. 8, 2009

(51) Int. Cl.
*H01R 13/648* (2006.01)

(52) U.S. Cl. ..... 439/607.25

(58) Field of Classification Search ..... 439/607.25, 439/541.5, 79, 660
See application file for complete search history.

(56) References Cited

U.S. PATENT DOCUMENTS 6,193,554 B1 * 2/2001 Wu ..... 439/607.25

* cited by examiner

*Primary Examiner*—Javaid Nasri
(74) *Attorney, Agent, or Firm*—Roger H. Chu

(57) ABSTRACT

A DisplayPort socket includes a first composite element and a second composite element. The first composite element includes a first insulating body partially and tightly covering plural terminals so that the terminals are exposed on a plate of the first insulating body and form plural conduction zones. The second composite element includes a second insulating body partially and tightly covering plural terminals so that the terminals are exposed on a plate of the second insulating body and form plural conduction zones. The plates of the first and second composite elements are stacked flat on each other to form a coupling plate for coupling buttingly with a DisplayPort connector. By integrating the first and second insulating bodies with their corresponding terminals to form the first and second composite elements and then assembling the first and second composite elements together, the terminals are securely positioned, thus increasing the reliability of the socket.

15 Claims, 12 Drawing Sheets

DISPLAY PORT SOCKET

BACKGROUND OF THE INVENTION

1. Technical Field

The present invention relates to an electronic connector and, more particularly, to a DisplayPort socket.

2. Description of Related Art

DisplayPort is a new-generation digital video interface standard advocated by the Video Electronics Standards Association (VESA). As transmission interface for computer monitors, DisplayPort supports the Plug-and-Play function and may hopefully replace the conventional LVDS, DVI, and VGA transmission interface.

Referring to FIG. 1, which is for a perspective view showing application of a typical DisplayPort socket. As shown in the drawing, a DisplayPort socket 10 and a matching DisplayPort connector 15, both conforming to the design rules set forth in the DisplayPort Standard, can be electrically connected to each other by their respective terminals, thus forming a DisplayPort interface for signal transmission.

With reference to FIG. 2, which is an exploded perspective view of a conventional DisplayPort socket 20. The DisplayPort socket 20 is assembled from an insulating body 21, a first terminal portion 231, a second terminal portion 232, and a metal housing 25. The insulating body 21 is provided with a coupling plate 210 and a terminal groove 213. The terminal groove 213 penetrates the insulating body 21 and extends along upper and lower surfaces of the coupling plate 210. Each of the first terminal portion 231 and the second terminal portion 232 includes a plurality of terminals, which are engaged with the insulating body 21 through the terminal groove 213 and are exposed on the coupling plate 210 so as to form conduction zones. The metal housing 25 is then mounted around the insulating body 21 to complete the DisplayPort socket 20.

The basic structure of the DisplayPort socket 20 is described above to shed light on the assembly process of conventional DisplayPort sockets. According to the above description, the terminals are fitted tightly into the terminal groove so as to be positioned in the insulating body, which is a well-established approach in the industry. However, during the fitting process, the terminals tend to be deflected so that the dimensions of the terminals in a finished product deviate from the design values. The difference between the actual dimensions and the design values of the terminals not only directly impacts the mechanical properties of the finished product, but also lowers the quality of high-frequency signals transmitted through the interface.

While the DisplayPort Standard has been updated to Version 1.1, the mechanism and electrical structure of DisplayPort continue to evolve. For example, the Mini DisplayPort design rules, proposed by Apple Inc. for the design of miniature interface, will be included in the next version of the DisplayPort Standard. However, if the existing configuration of DisplayPort sockets is to prevail, low product quality and low product yield will ensue so that the reliability of backend application devices will be impaired, and consumers' rights, compromised.

BRIEF SUMMARY OF THE INVENTION

Therefore, it is an objective of the present invention to provide a DisplayPort socket whose terminals are integrated with insulating bodies to form composite elements so that the insulating bodies tightly cover and thus securely position the terminals.

Another objective of the present invention is to provide a DisplayPort socket wherein an auxiliary shielding element serves to suppress electromagnetic interference and protect the transmission quality of electronic signals.

To achieve the above and other objectives, the present invention provides a DisplayPort socket conforming to the DisplayPort design rules. The DisplayPort socket includes a first composite element and a second composite element. The first composite element includes a plurality of terminals and a first insulating body. The first insulating body partially and tightly covers the terminals of the first composite element and has a first connecting portion and a plate having a surface formed with a plurality of open holes. The terminals of the first composite element are exposed through the open holes of the first insulating body so as to form a plurality of conduction zones. The second composite element is configured for coupling with the first composite element and includes a plurality of terminals and a second insulating body. The second insulating body partially and tightly covers the terminals of the second composite element and has a second connecting portion and a plate having a surface formed with a plurality of open holes. The terminals of the second composite element are exposed through the open holes of the second insulating body so as to form a plurality of conduction zones.

The first connecting portion of the first composite element is engaged with the second connecting portion of the second composite element so that the plate of the first composite element and the plate of the second composite element are stacked flat on each other, with their respective conduction zones exposed. Thus, the plates jointly form a coupling plate to be coupled buttingly with a DisplayPort connector.

Each of the terminals of the first composite element has a pin exposed outside the first insulating body. On the other hand, each of the terminals of the second composite element has a pin exposed outside the second insulating body.

The DisplayPort socket further includes a metal housing enclosing the first composite element and the second composite element. The metal housing has an opening through which the metal housing and the coupling plate jointly form a coupling groove for being inserted by and thus coupling with a DisplayPort connector.

In an embodiment of the present invention, the DisplayPort socket further includes a base configured for coupling with the first composite element and the second composite element. The base includes a plurality of terminal guide holes for being inserted by and thus positioning the pins of the terminals of the first and second composite elements, respectively.

In an embodiment of the present invention, the DisplayPort socket further includes an auxiliary shielding element settled in the base. The auxiliary shielding element has a shielding plate disposed outward of the pins of the terminals of the first and second composite elements and facing the coupling plate.

Therefore, in the DisplayPort socket of the present invention, the first insulating body and the second insulating body are integrated with the corresponding terminals in advance so as to form the first composite element and the second composite element, respectively, wherein the first insulating body and the second insulating body partially and tightly cover the terminals of the first composite element and of the second composite element, respectively. Then, the first composite element and the second composite element are assembled together, thus securing the terminals in position with enhanced firmness.

Besides, in the DisplayPort socket of the present invention, the shielding plate of the auxiliary shielding element is disposed outward of the pins of the terminals of the first and second composite elements so as to suppress electromagnetic interference and protect the transmission quality of electronic signals. Thus, the present invention effectively increases the reliability of the finished DisplayPort socket.

BRIEF DESCRIPTION OF THE SEVERAL VIEWS OF THE DRAWINGS

The technical means adopted by the present invention to achieve the above objectives, as well as the advantages and other objectives of the present invention, can be best understood by referring to the following detailed description and the accompanying drawings, wherein.

DETAILED DESCRIPTION OF THE INVENTION

The present invention provides a DisplayPort socket conforming to the DisplayPort Standard. The various features of the present invention are described hereinafter by reference to an embodiment of a DisplayPort socket that is configured according to the Mini DisplayPort design rules established by Apple Inc.

Figure 1:
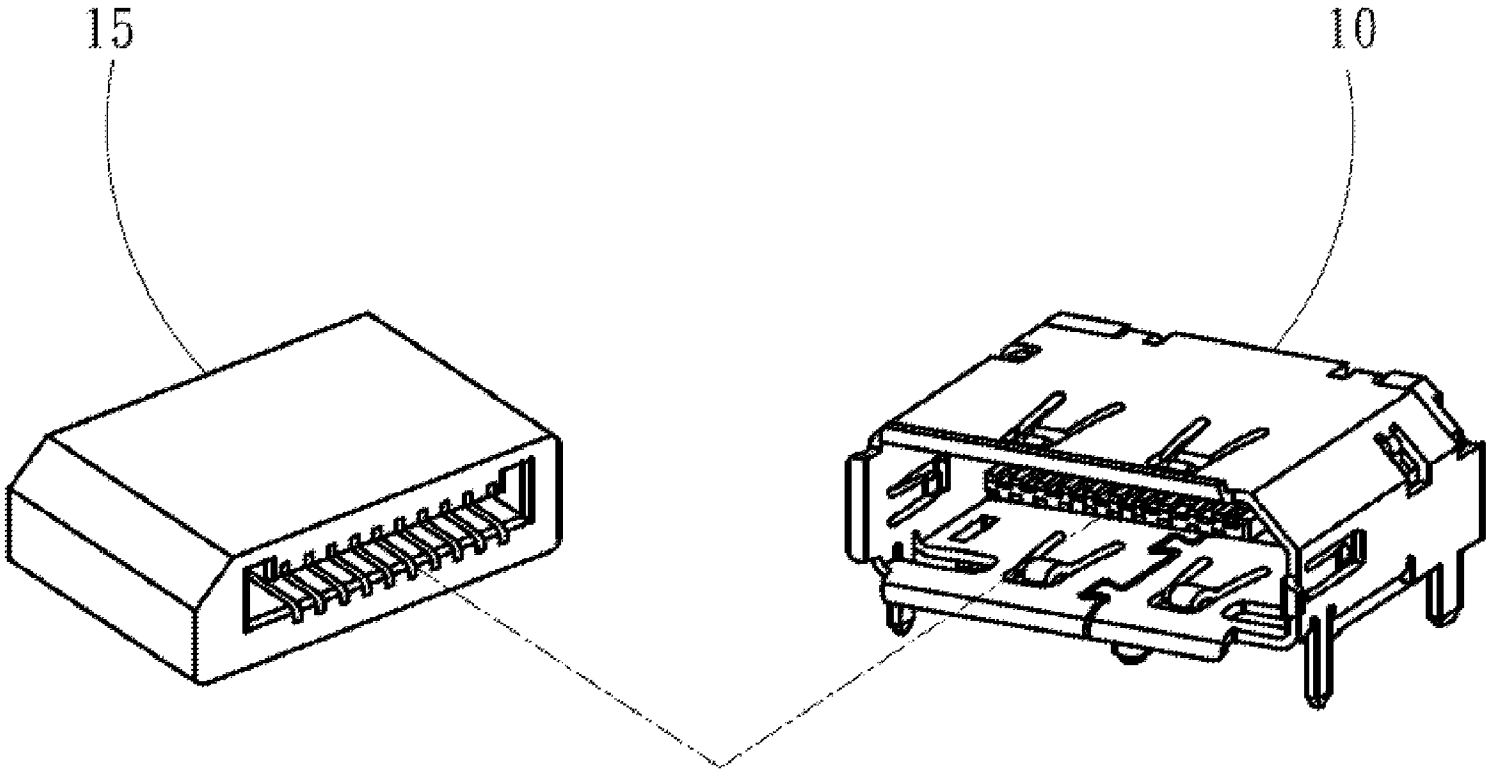
FIG. 1 (PRIOR ART)
FIG. 1 is a perspective view showing application of a typical DisplayPort socket.
Figure 2:
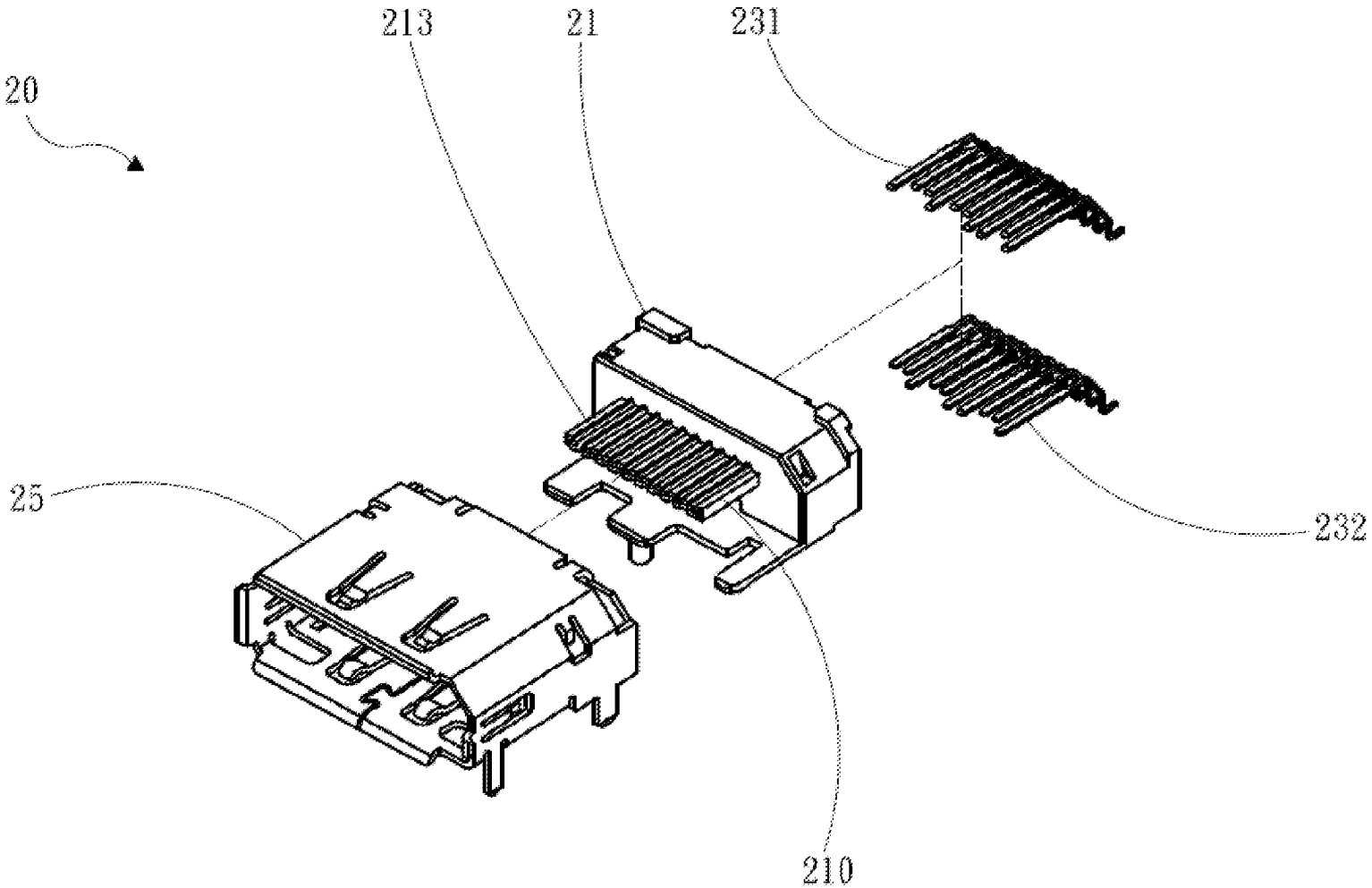
FIG. 2 (PRIOR ART)
FIG. 2 is an exploded perspective view of a conventional DisplayPort socket.
Figure 3:
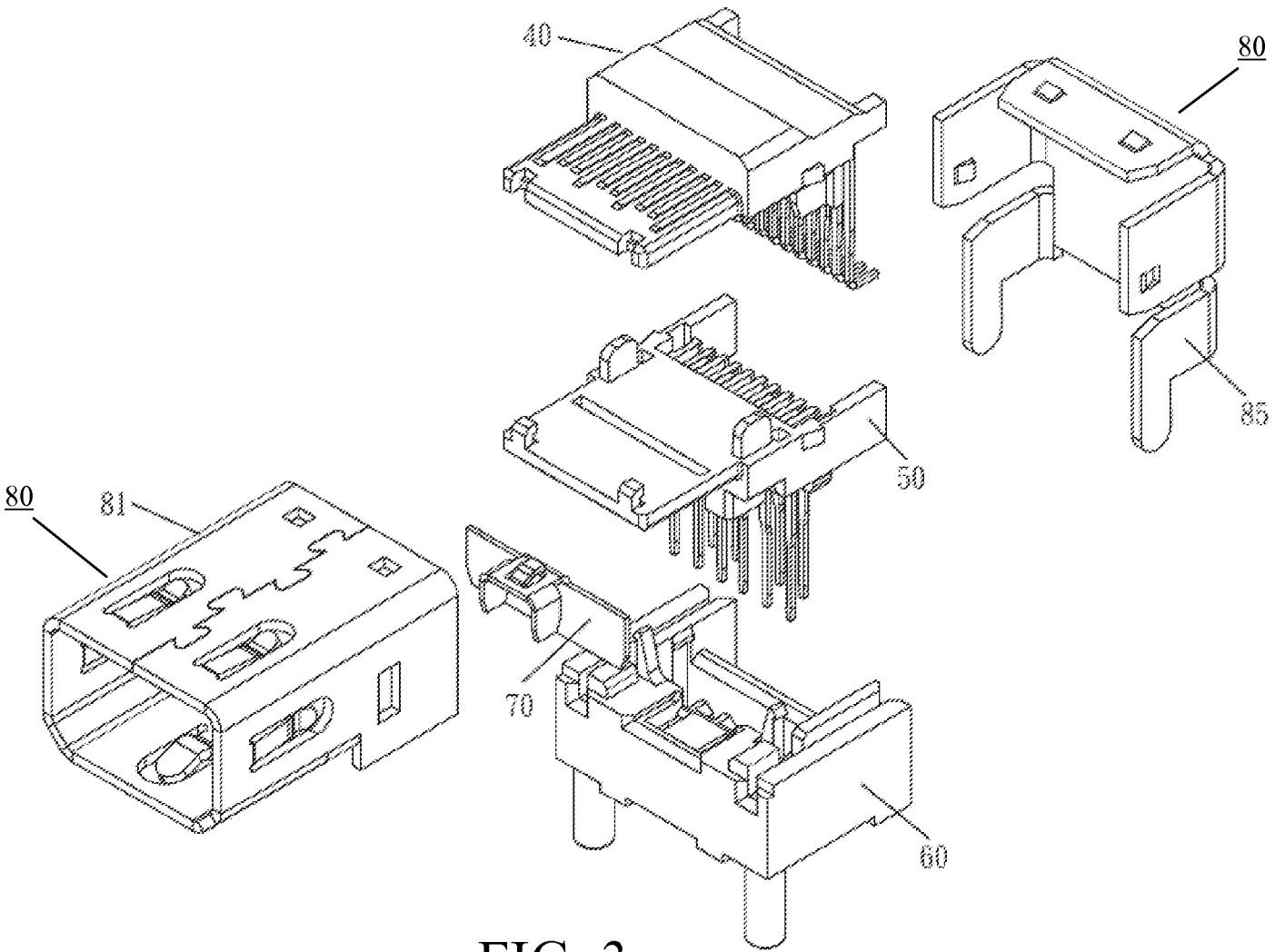
FIG. 3 is an exploded perspective view of a DisplayPort socket according to an embodiment of the present invention.

Referring to FIG. 3 for an exploded perspective view of a DisplayPort socket 30 according to an embodiment of the present invention, the DisplayPort socket 30 includes a first composite element 40, a second composite element 50, a base 60, an auxiliary shielding element 70, and a metal housing 80, wherein the metal housing 80 is composed of a first housing member 81 and a second housing member 85.

Figure 4:
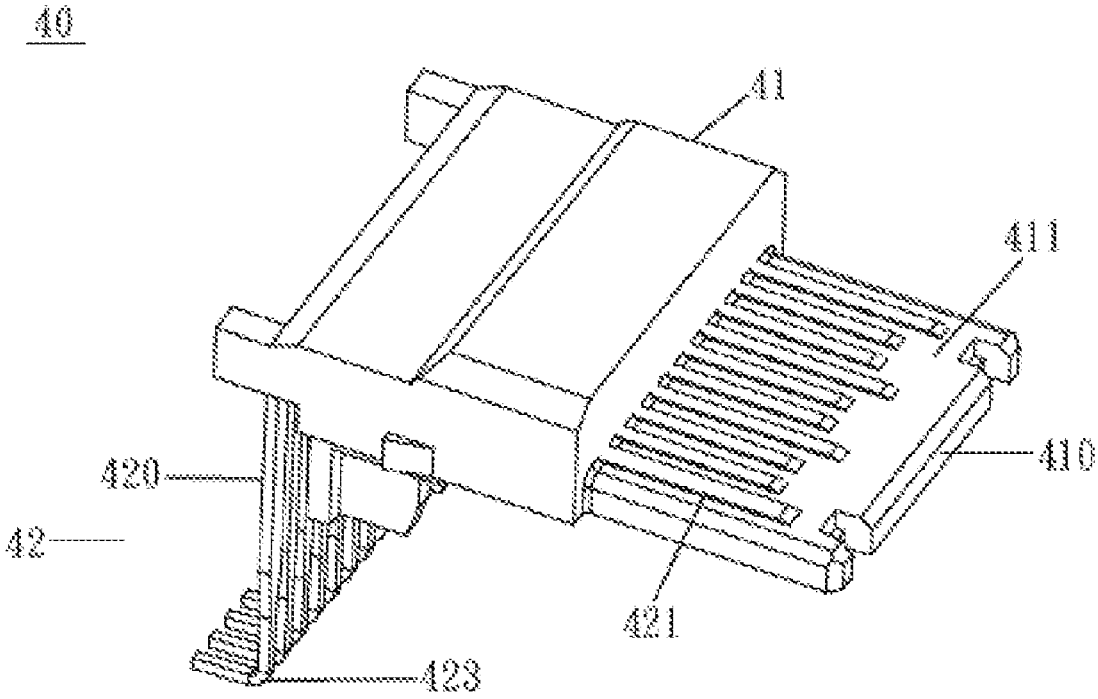
FIG. 4 is a perspective view of a first composite element according to the present invention.
Figure 5:
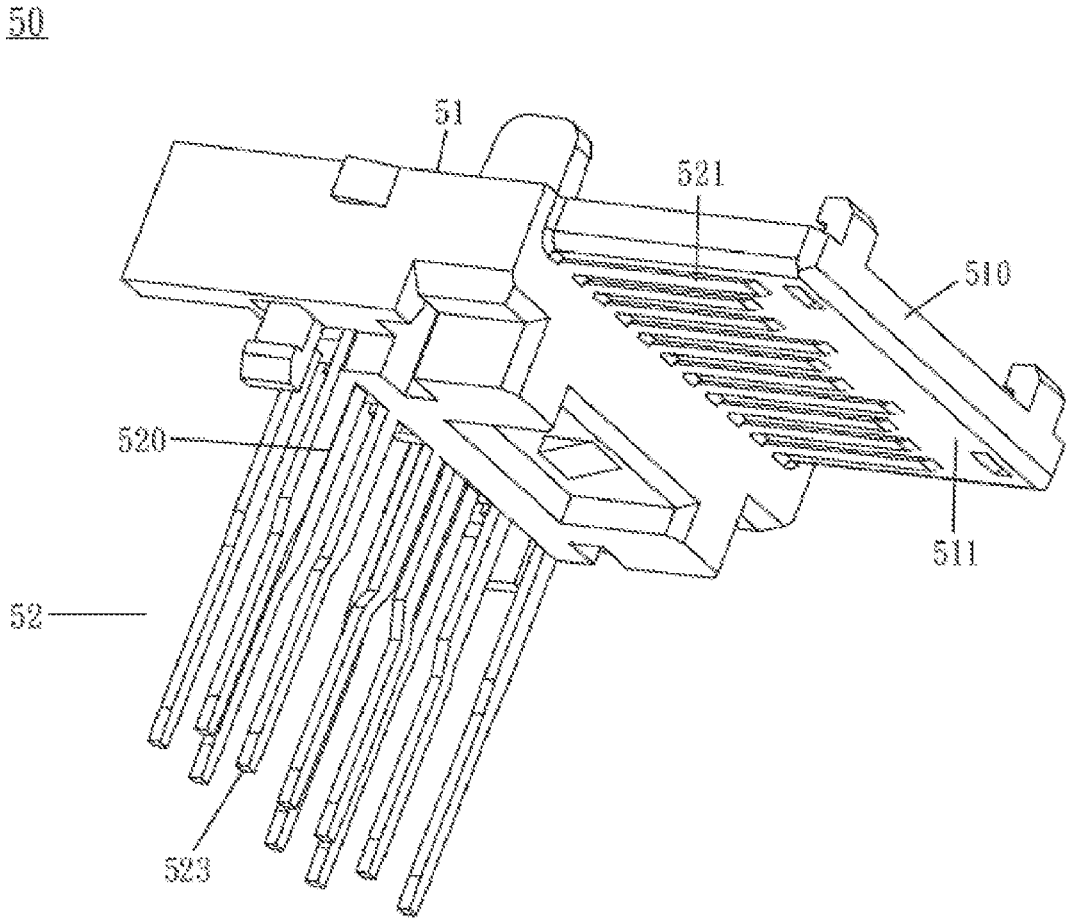
FIG. 5 is a perspective view of a second composite element according to the present invention.

FIG. 4 and FIG. 5 are perspective views of the first composite element 40 and the second composite element 50, respectively. As shown in the drawings, the first composite element 40 includes an insulating body 41 and a first terminal portion 42 composed of a plurality of L-shaped terminals 420 arranged in a row. The first insulating body 41 covers the terminals 420 partially and tightly. Additionally, the first insulating body 41 has a plate 410 having a surface 411 formed with a plurality of open holes. The terminals 420 are exposed on the surface 411 of the plate 410 through the open holes of the first insulating body 41 and thus form a plurality of conduction zones 421 which are configured for abutting against and thereby establishing electrical connection with terminals of a DisplayPort connector so as to enable signal transmission. Each of the terminals 420 has a pin 423 exposed outside the first insulating body 41. The exposed pins 423 of the terminals 420 are arranged in a row and configured for being surface-welded to welding pads on a circuit board.

The second composite element 50 includes a second insulating body 51 and a second terminal portion 52 composed of a plurality of L-shaped terminals 520 arranged in a row. The second insulating body 51 covers the terminals 520 partially and tightly. In addition, the second insulating body 51 has a plate 510 which has a surface 511 formed with a plurality of open holes. The terminals 520 are exposed on the surface 511 of plate 510 through the open holes of the second insulting body 51, thus forming a plurality of conduction zones 521 configured for abutting against and electrically connecting with terminals of a DisplayPort connector so as to enable signal transmission. Each of the terminals 520 has a pin 523 exposed outside the second insulating body 51. The exposed pins 523 are arranged in two rows and configured for inserting into conduction holes of a circuit board.

One feature of the present invention lies in the manufacturing process of the first insulating body 41 and the second insulating body 51, whereby the first terminal portion 42 is integrated with the first insulating body 41 in advance, and the second terminal portion 52 is integrated with the second insulating body 51 in advance so as to form the first composite element 40 and the second composite element 50, respectively. Through this manufacturing process, which is intended to replace a corresponding assembly process of the conventional DisplayPort socket, the first insulating body 41 partially and tightly covers each terminal 423 of the first terminal portion 42, and the second insulating body 51 partially and tightly covers each terminal 523 of the second terminal portion 52. The terminals 423 and 523 are thus positioned with enhanced firmness and less likely to be deflected by external force. As a result, the spacing between the terminals of the finished product shall conform to the design values so that the finished product, having the mechanical and electronic properties set forth in the Standard, is made highly reliable.

In an embodiment of the present invention, the first composite element 40 and the second composite element 50 are made by a forming process of the first insulating body 41 and the second insulating body 51 in which the first insulating body 41 and the second insulating body 51 are injection-molded respectively from a thermoplastic material. The forming process is now described in more detail by reference to the first composite element 40 for example. To begin with, an injection mold is designed according to the desired dimensions. Then, after the terminals 420 of the first terminal portion 42 are positioned in the mold, the plastic material is injected into the mold and let solidify so as to take form. By virtue of the thermoplasticity of the plastic material, the first insulating body 41 is tightly bonded with the terminals 420 where they are in contact with each other so that the terminals 420 are secured in position with enhanced mechanical stability.

Figure 6:
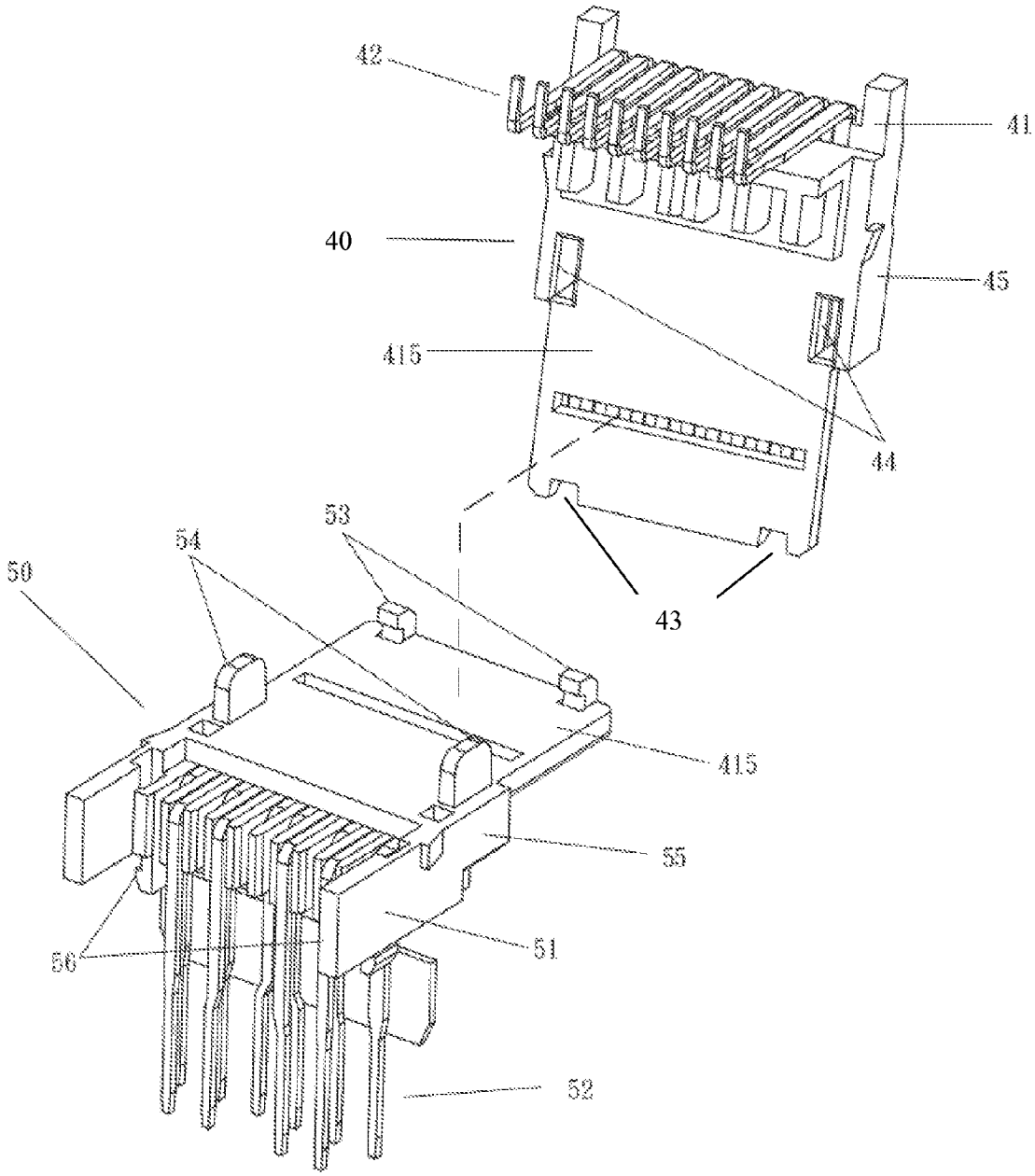
FIG. 6 and FIG. 7 are perspective views showing assembly of the first and second composite elements according to the present invention.
Figure 7:
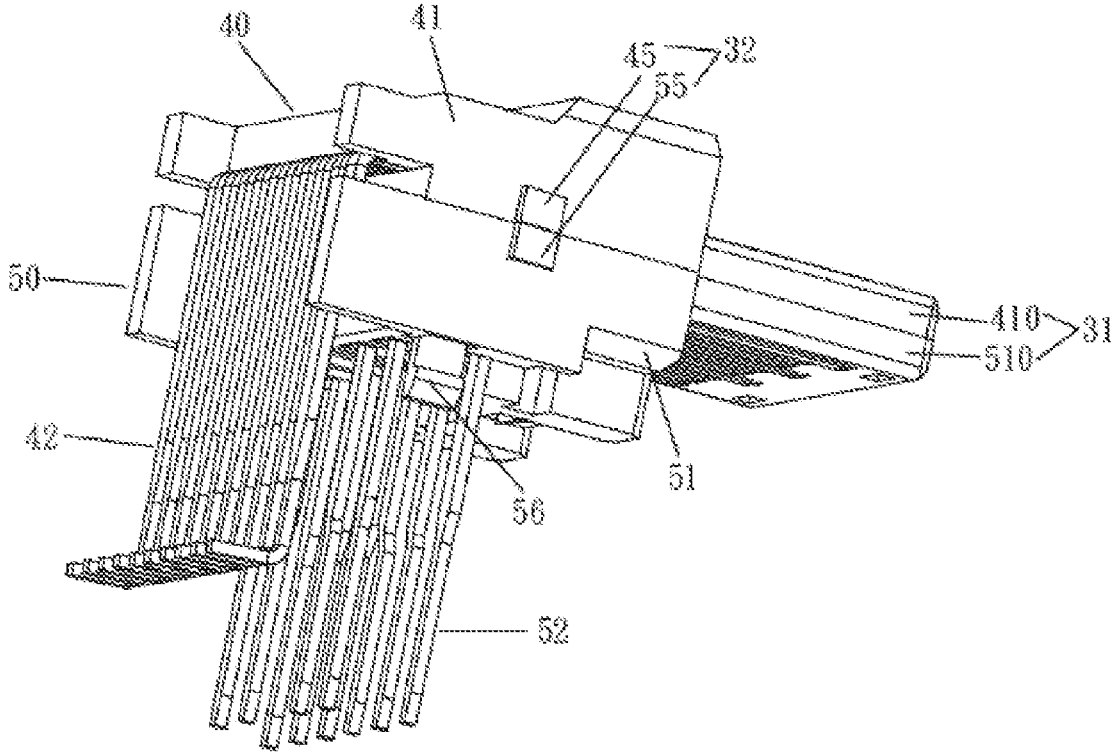

Refer now to FIG. 6 and FIG. 7 for perspective views showing assembly of the first composite element 40 and the second composite element 50. In the first composite element 40, the first insulating body 41 has a surface 415 which is opposite to the surface 411 (see FIG. 4) of the plate 410 and provided with first connecting portions 43 and 44. In addition, the first insulating body 41 further has surfaces which are perpendicular to the surface 411 (see FIG. 4) of the plate 410 and the surface 415 and are provided respectively with first stop blocks 55. In the second composite element 50, the second insulating body 51 has a surface 515 which is opposite to the surface 511 (see FIG. 5) of the plate 510 and provided with second connecting portions 53 and 54. Furthermore, the second insulating body 51 has surfaces which are perpendicular to the surface 511 (see FIG. 5) of the plate 510 and the surface 515 and are provided respectively with second stop blocks 55. A resilient projection 56 is provided at a bottom of each of the second stop blocks 55.

The first connecting portions 43, 44 and the second connecting portions 53, 54 are shown in FIGS. 6 and 7 as corresponding tenons and mortises, respectively, which serve to couple the first composite element 40 tightly to the second composite element 50 so that the plate 410 of the first composite element 40 is stacked flat on the plate 510 of the second composite element 50 while the conduction zones of the first composite element 40 and of the second composite element 50 are exposed, and in consequence the plates 410 and 510 jointly form a coupling plate 31 to be coupled buttingly with a DisplayPort connector.

Meanwhile, each of the first stop blocks 45 is also coupled with a corresponding one of the second stop blocks 55, thus forming assembled stop blocks 32.

Figure 8:
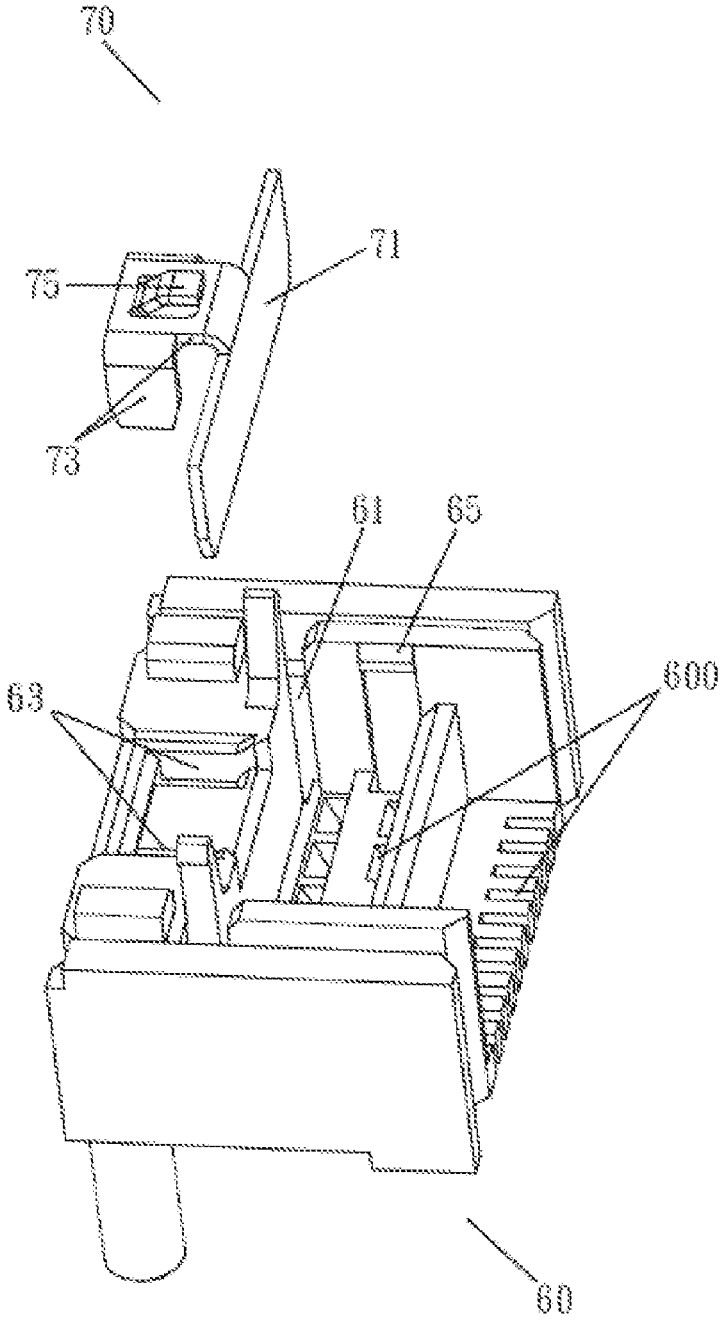
FIG. 8 is a perspective view of a base and an auxiliary shielding element according to the present invention.
Figure 9:
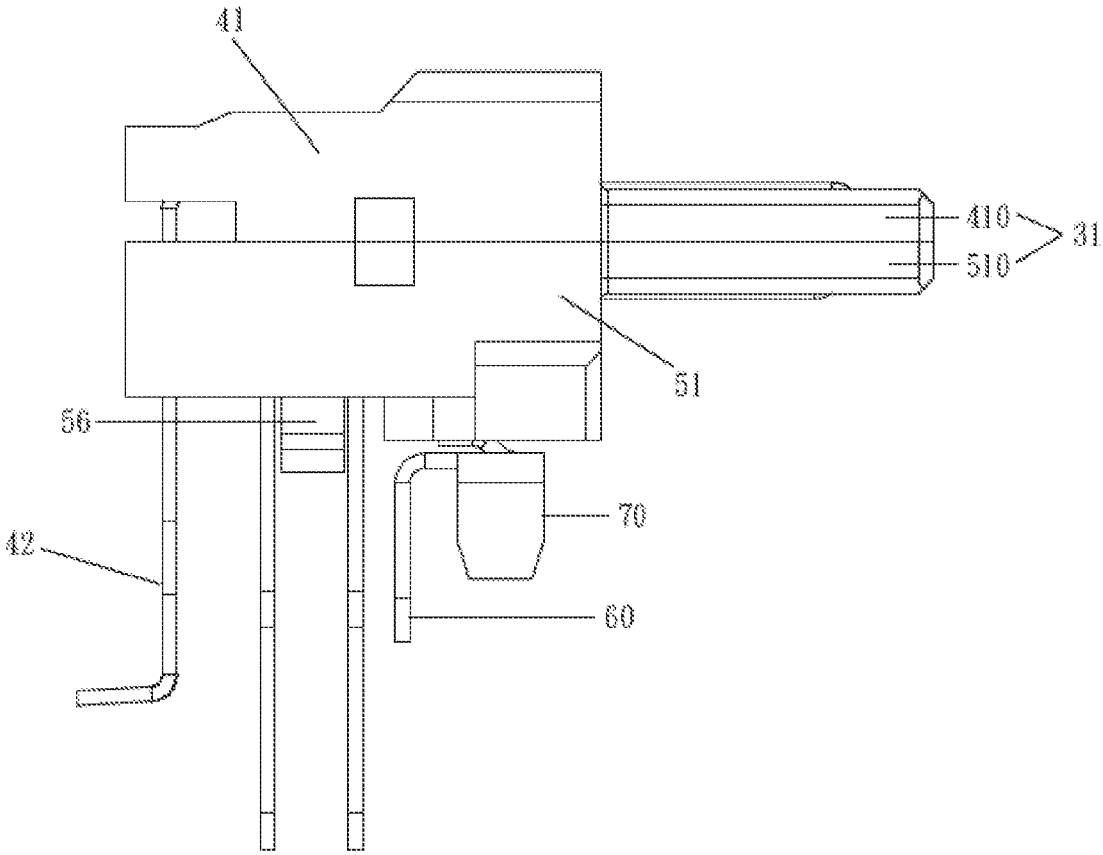
FIG. 9 is a partially assembled see-through side elevation of a DisplayPort socket according to the present invention, showing the position of the auxiliary shielding element relative to pins.

Another feature of the present invention consists in the provision of the auxiliary shielding element 70, as explained in detail by reference to FIG. 8 and FIG. 9, wherein FIG. 8 is a perspective view showing assembly of the base 60 and the auxiliary shielding element 70, and FIG. 9 is a partially assembled see-through side elevation of the DisplayPort socket 30 according to the present invention, showing the position of the auxiliary shielding element 70 relative to the pins 423 and 523.

As shown in FIGS. 8 and 9, the auxiliary shielding element 70 has a shielding plate 71, a wing-shaped positioning portion 73, and a hook 75. The base 60 has a receiving groove 61, a positioning recess 63, and a positioning hole 65. The auxiliary shielding element 70 is installed in the base 60. The receiving groove 61 corresponds in configuration to the shielding plate 71 and serves to receive the shielding plate 71. The positioning recess 63 corresponds in configuration to the positioning portion 73 so that the positioning portion 73 can be inserted into the positioning recess 63, thereby fastening the auxiliary shielding element 70 to the base 60 and fitting the shielding plate 71 in the receiving groove 61.

The base 60 is provided with a plurality of terminal guide holes 600 corresponding in arrangement and position to the pins of the terminals of the first terminal portion 42 and of the second terminal portion 43 (see FIG. 6). Hence, the pins can be inserted and positioned in the terminal guide holes 600 so that the assembly depicted in FIG. 7 of the first composite element 40 and the second composite element 50 is further coupled with the base 60. The coupling process is completed when the resilient projections 56 of the second composite element 50 are engaged with the positioning holes 65.

At this time, the shielding plate 71 is located exactly outward of the pins of the first terminal portion 42 and of the second terminal portion 52 and faces the coupling plate 31 so as to suppress leak of high-frequency signals from the pins of the terminals 420 and 520 through radiation while preventing external noise from interfering with the signals at the terminals 420 and 520.

Figure 10:
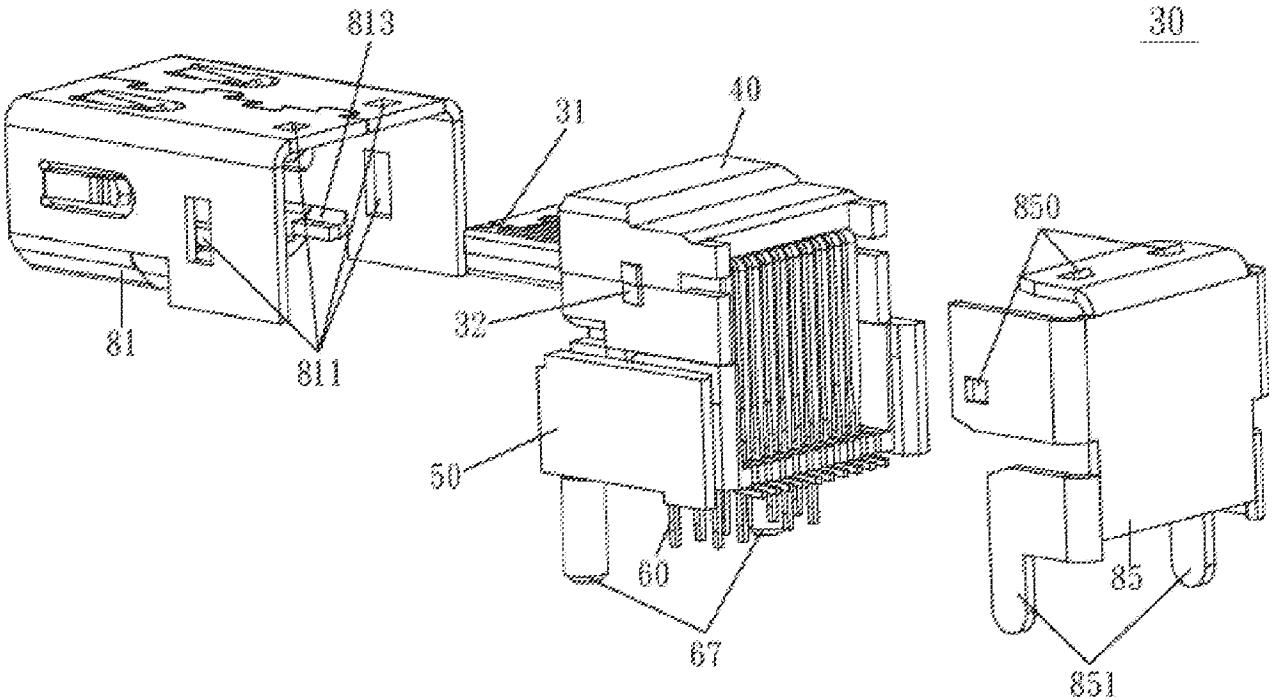
FIG. 10 and FIG. 11 are partially exploded perspective views of the DisplayPort socket according to the present invention as seen from different viewing angles.
Figure 11:
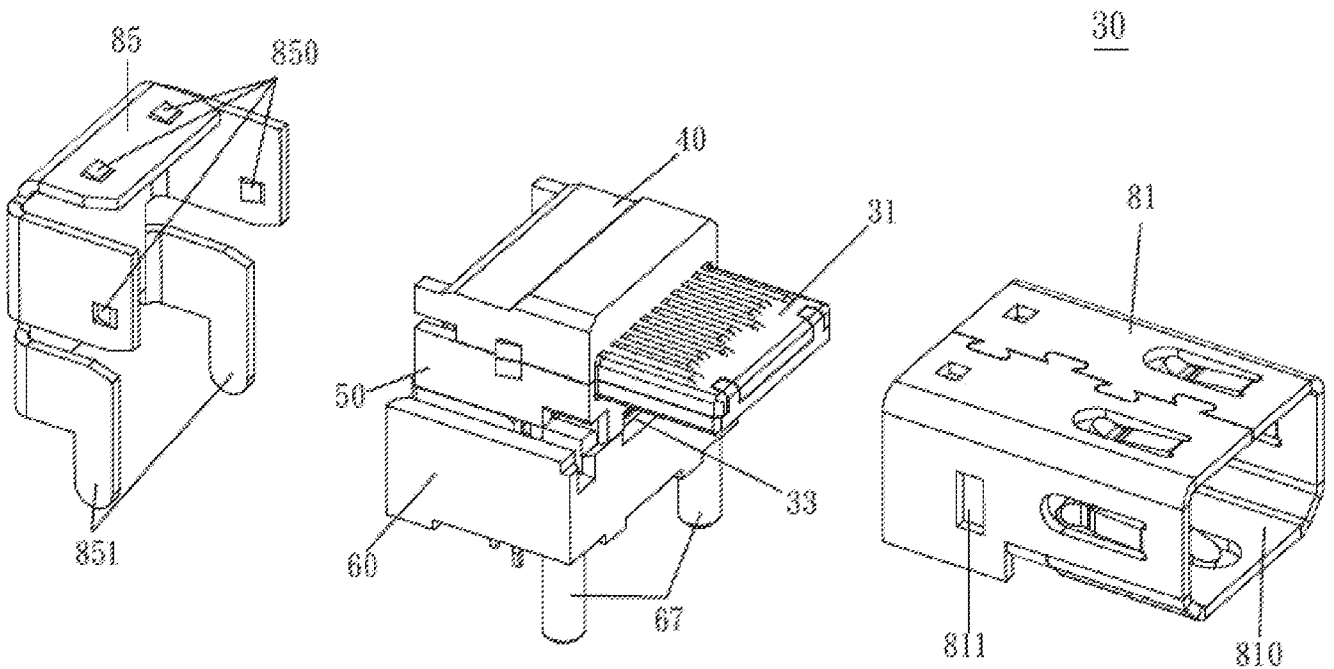
Figure 12:
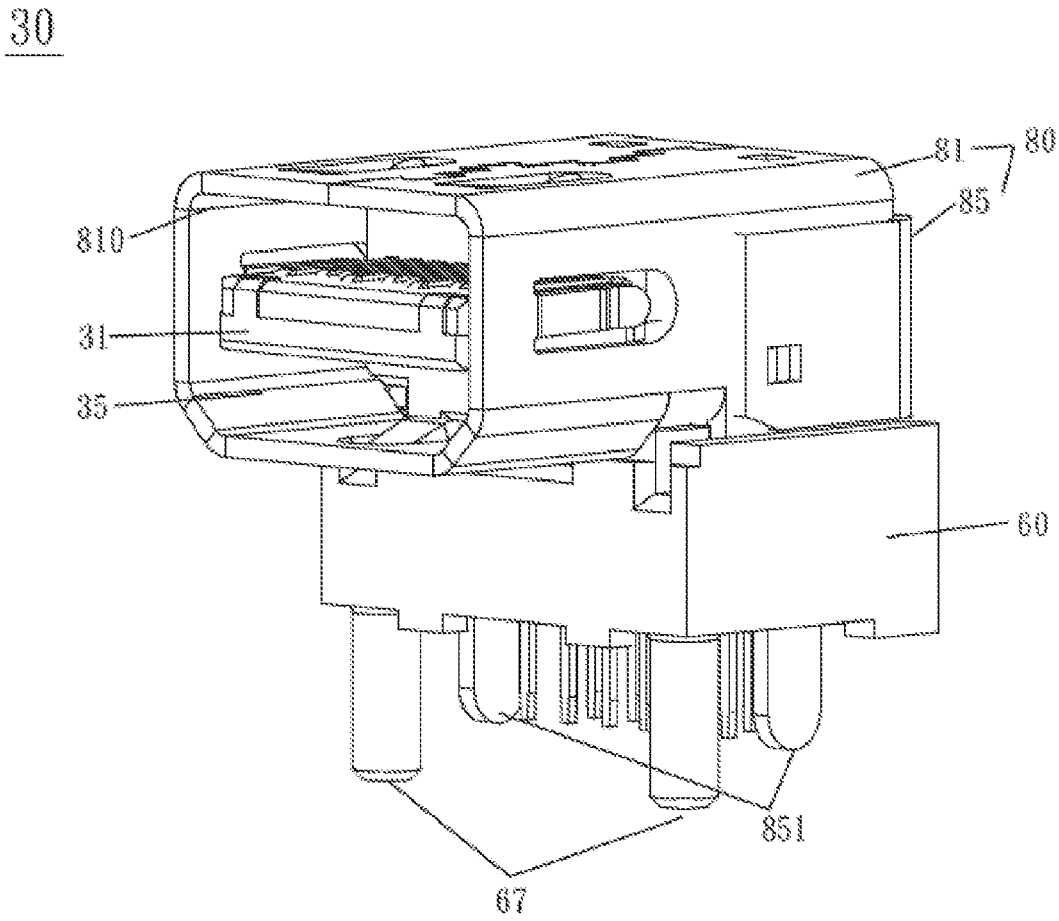
FIG. 12 is a perspective view of the DisplayPort socket according to the present invention.

Finally, reference is made to FIGS. 10, 11, and 12, wherein FIG. 10 and FIG. 11 are partially exploded perspective views of the DisplayPort socket 30 according to the present invention, taken from different viewing angles, and FIG. 12 is an assembled perspective view of the DisplayPort socket 30. As shown in the drawings, after the assembly of the first and second composite elements 40 and 50 is coupled with the base 60 to form a semi-finished product, the first housing member 81 and the second housing member 85 are assembled to and thereby enclose the semi-finished product.

The first housing member 81, which is a generally rectangular prism-shaped housing, has an opening 810 and is provided with a positioning pin 813 and a plurality of assembly holes 811. After the assembly of the first and second composite elements 40 and 50 is coupled with the base 60, an assembly slot 33 is formed so that the hook 75 (see FIG. 8) of the auxiliary shielding element 70 (see FIG. 8) is exposed in the assembly slot 33. A positioning pin 813 of the first housing member 81 is configured for inserting into the assembly slot 33 and engaging with the hook 75 (see FIG. 8). Meanwhile, the assembled stop blocks 32 are also engaged in the corresponding assembly holes 811.

The second housing member 85 is brought to the first housing member 81 from a direction where the pins of the terminals 420 and 520 are located, so as to couple buttingly with the first housing member 81. The second housing member 85 is provided with a plurality of assembly lugs 850 and two grounding straps 851. The assembly lugs 850 are engaged in the corresponding assembly holes 811 of the first housing member 81, thereby fastening the first housing member 81 and the second housing member 85 to the semi-finished product composed of the first composite element 40, the second composite element 50, and the base 60. Through the opening 810, the metal housing 80 and the coupling plate 31 jointly form a coupling groove 35 for being inserted by and thus coupling with a DisplayPort connector. On the other hand, positioning posts 67 of the base 60 assist in positioning the DisplayPort socket 30 on a circuit board while the grounding straps 851 of the second housing member 85 provide a grounding function.

It is worth mentioning that the DisplayPort socket 30 conforms to the specifications of the DisplayPort Standard in such details as the arrangement and dimension of pins, the general structure and dimension of the socket, and materials of the components. Such details are not explained herein for the sake of brevity.

It should also be noted that the DisplayPort socket 30 can be incorporated with connectors of other specifications so as form a composite socket to be installed in information equipment. In other words, the concept of the present invention can be further applied to composite sockets. In practice, a composite socket having the features of the present invention can be made by modifying the length and structure of the terminals and designing a suitable metal housing according to the configuration of the socket.

It can be known from the detailed description presented above that, by integrating the insulating bodies with the terminals in advance, the terminals in the DisplayPort socket of the present invention are secured in position with enhanced firmness. Besides, by placing the shielding plate of the auxiliary shielding element outward of the pins of the terminals of the first and second composite elements, electromagnetic interference is suppressed with increased efficiency so that the transmission quality of electronic signals is protected. Hence, it is ensured that the electronic and mechanical properties of the finished DisplayPort socket will conform to the DisplayPort Standard while the reliability of the finished product is raised.

The present invention is detailed herein by reference to the embodiment and the accompanying drawings. However, it is understood that the embodiment is not intended to limit the scope of the present invention, which is defined only by the appended claims. Therefore, any changes or modifications that are easily conceivable by a person skilled in the art should be encompassed by the appended claims.

What is claimed is:

1. A DisplayPort socket comprising:

a first composite element comprising a plurality of terminals and a first insulating body, wherein the first insulating body partially and tightly covers the terminals of the first composite element and has a first connecting portion and a plate that has a surface formed with a plurality of open holes so that the terminals of the first composite element are exposed through the open holes of the first insulating body and thus form a plurality of conduction zones; and a second composite element configured for coupling with the first composite element and comprising a plurality of terminals and a second insulating body, wherein the second insulating body partially and tightly covers the terminals of the second composite element and has a second connecting portion and a plate that has a surface formed with a plurality of open holes so that the terminals of the second composite element are exposed through the open holes of the second insulating body and thus form a plurality of conduction zones;

wherein the first connecting portion and the second connecting portion are engaged with each other so that the plate of the first composite element and the plate of the second composite element are stacked flat on each other while the conduction zones of the first composite element and of the second composite element are exposed, thus the plates jointly forming a coupling plate to be coupled buttingly with a DisplayPort connector.

2. The DisplayPort socket of claim 1, wherein the first insulating body and the second insulating body are made of a plastic material.

3. The DisplayPort socket of claim 2, wherein the first insulating body is injection-molded from the plastic material so as to partially and tightly cover each said terminal of the first composite element.

4. The DisplayPort socket of claim 2, wherein the second insulating body is injection-molded from the plastic material so as to partially and tightly cover each said terminal of the second composite element.

5. The DisplayPort socket of claim 1, wherein each said terminal of the first composite element has a pin exposed outside the first insulating body, and each said terminal of the second composite element has a pin exposed outside the second insulating body.

6. The DisplayPort socket of claim 5, further comprising a base configured for coupling with the first composite element and the second composite element, wherein the base comprises a plurality of terminal guide holes for being inserted by and thus positioning the pins of the terminals of the first composite element and the pins of the terminals of the second composite element, respectively.

7. The DisplayPort socket of claim 6, further comprising an auxiliary shielding element provided in the base, wherein the auxiliary shielding element has a shielding plate disposed outward of the pins of the terminals of the first composite element and the pins of the terminals of the second composite element and facing the coupling plate.

8. The DisplayPort socket of claim 7, wherein the base is provided with a receiving groove for receiving the shielding plate.

9. The DisplayPort socket of claim 7, wherein the auxiliary shielding element has a positioning portion, and the base is provided with a positioning recess, the positioning portion being coupled with the positioning recess so that the auxiliary shielding element is positioned in the base.

10. The DisplayPort socket of claim 6, wherein the second composite element is provided with at least a resilient projection, and the base is provided with at least a positioning hole for being coupled with the resilient projection so that when the resilient projection and the positioning hole are coupled with each other, the second composite element and the first composite element are jointly positioned in the base.

11. The DisplayPort socket of claim 6, further comprising a metal housing provided around the first composite element, the second composite element, and the base.

12. The DisplayPort socket of claim 11, wherein the metal housing comprises a first housing member and a second housing member brought together from a direction where the coupling plate is located and a direction where the pins of the terminals of the first composite element are located, respectively, so as to enclose the first composite element, the second composite element, and the base.

13. The DisplayPort socket of claim 12, wherein the first housing member is provided with at least an assembly hole, and the second housing member is provided with at least an assembly lug for being engaged with the at least an assembly hole so that when the at least an assembly lug and the at least an assembly hole are engaged with each other, the first housing member is fastened to the second housing member.

14. The DisplayPort socket of claim 12, wherein the first composite element has at least a stop block and the first housing member is provided with at least an assembly hole for being engaged with the stop block so that the first housing member is fastened around the first composite element, the second composite element, and the base.

15. The DisplayPort socket of claim 12, wherein the second composite element has at least a stop block and the first housing member is provided with at least an assembly hole for being engaged with the stop block so that the first housing member is fastened around the first composite element, the second composite element, and the base.

* * * * *